United States Patent [19]

Cimino

[11] Patent Number: 4,733,703

[45] Date of Patent: Mar. 29, 1988

[54] COMBINATION TOOL CHEST/WORKBENCH

[76] Inventor: Eugene D. Cimino, 215 Pochet La., Schaumburg, Ill. 60193

[21] Appl. No.: 852,743

[22] Filed: Apr. 16, 1986

[51] Int. Cl.[4] ..... B25H 1/12

[52] U.S. Cl. ..... 144/285; 144/286 R; 206/373

[58] Field of Search ..... 206/372, 373, 349; 144/285, 286 R

[56] References Cited

U.S. PATENT DOCUMENTS

| | | | |
|---|---|---|---|
| 581,829 | 5/1897 | Pecoy . | |
| 1,160,380 | 11/1915 | Converse . | |
| 1,287,175 | 12/1918 | Anderson . | |
| 1,459,930 | 6/1923 | Riehle . | |
| 1,688,533 | 10/1928 | Eger . | |
| 1,984,345 | 12/1934 | Kennedy | 206/373 |
| 2,525,208 | 10/1980 | Clink | 206/373 |
| 2,646,330 | 7/1953 | Swainbank . | |
| 3,092,428 | 6/1963 | Kerschner | 206/373 |
| 3,118,685 | 1/1964 | Jordan . | |
| 4,211,455 | 7/1980 | Tedrow | 206/373 |

*Primary Examiner*—W. Donald Bray
*Attorney, Agent, or Firm*—Marshall, O'Toole, Gerstein, Murray & Bicknell

[57] ABSTRACT

The present disclosure relates to a combination workbench and tool chest. The structure includes a working surface supported by a rigid frame. Tool storing means including pegboards, shelves and drawers are mounted on the rigid frame below the surface for the storage of tools, on at least three sides of the frame. A set of removable security panels are mounted in grooves or tracks in the frame to enclose the sides of the frame and the tools. When the panels are in place, they interact with each other so that only one lock is needed to lock all three sides of the bench. When the panels are removed, access to the stored tools is available from fully three sides of the bench. The fourth side of the bench is formed by a lockable door that covers shelves, drawers, etc. At least one bin for storing small articles is mounted at one edge of the bench surface, in a way such that it can be pulled up onto the bench surface when needed or swung back into storage (behind the panels) to expose an unobstructed bench, without the need to remove or adjust the bench itself.

8 Claims, 8 Drawing Figures

COMBINATION TOOL CHEST/WORKBENCH

BACKGROUND OF THE INVENTION

The present invention relates generally to workbenches and tool chests, and more particularly to a combination workbench and tool chest including theft prevention arrangements.

A typical combination workbench and tool chest is used by a professional or home handyman who needs to store a large collection of tools and equipment and who also needs a workbench but desires both in a single, compact unit. It is useful for the home handyman who is usually confined to a limited work space and cannot afford the luxury of spreading his work out over a large area. A professional workman, such as a carpenter or mechanic, needs to be able to securely store his collection of tools and equipment at a job site or garage.

If a professional workman is to leave his tools and equipment at a job site, he needs a chest which can be securely locked to prevent theft. Unfortunately, this need for security conflicts, in principle, with the other essential requirement of a chest, that is, that it provide him with easy accessibility to his tools.

Indeed, one of the principal problems with current combination workbench and tool chest designs is that access to the storage areas of the chest is limited. Some designs provide for access to the storage areas by lifting or removing the bench work—the flaw of such designs being that while the device is being used as a workbench, access to the storage areas is made difficult or impossible. Other designs may provide for storage spaces beneath the bench surface, which are accessible through a door or opening on one side of the bench. While these designs do allow some access to the storing areas while the work surface is being used, access to the tools and equipment is still impaired by the closed sides of the bench. The provision of drawers is of limited value in easing this problem, since their use for storage of bulky items is usually inefficient.

Additionally, few, if any, combination tool chest and workbench designs make any provision for the convenient storage of small articles such as washers, nails, etc.

Another major problem with some current designs is that they do not provide an unobstructed bench surface extending to all edges of the bench. Backs, trays or boxes mounted above the plane of the work surface decrease the value of the surface in that they prevent the workman from extending his material over the side of the bench. Other designs make no provision for extending the work surface, or any provision for extending the surface while at the same time maintaining a continuous flat surface. An uneven work surface is of little value in supporting long, rigid items.

SUMMARY OF THE INVENTION

The present invention eliminates the drawbacks and disadvantages of the previous combination workbench and tool chest designs described above. It also contains new and useful improvements.

The design according to this invention takes the form of a working surface supported by a rigid frame. Tool storing means including pegboards, shelves and drawers are mounted on the rigid frame below the surface for the storage of tools, on at least three sides of the frame. A set of removable panels are mounted in grooves or tracks in the frame to enclose the sides of the frame. When the panels are in place, they interact with each other so that only one lock is needed to lock all three sides of the bench. When the panels are removed, access to the stored tools is available from fully three sides of the bench. Further, this improved accessibility feature is not impaired even when the working surface of the bench is in use. The fourth side of the bench is formed by a lockable door that covers shelves, drawers, etc.

Another feature of the invention is a novel arrangement for the storage of small articles. At least one bin for storing such articles is mounted at one edge of the bench surface, in a way such that it can be pulled up onto the bench surface when needed or swung back into storage (behind the panels) to expose an unobstructed bench, without the need to remove or adjust the bench itself. This provides a convenient means for storing such small articles, while allowing convenient access to the articles even when the workbench is in use.

BRIEF DESCRIPTION OF THE DRAWING

The invention will be better understood from the following detailed description taken in conjunction with the accompanying figures of the drawings, wherein.

DETAILED DESCRIPTION

The drawings illustrate a specific embodiment of a combination workbench and tool chest in accordance with the present invention.

Figure 4:
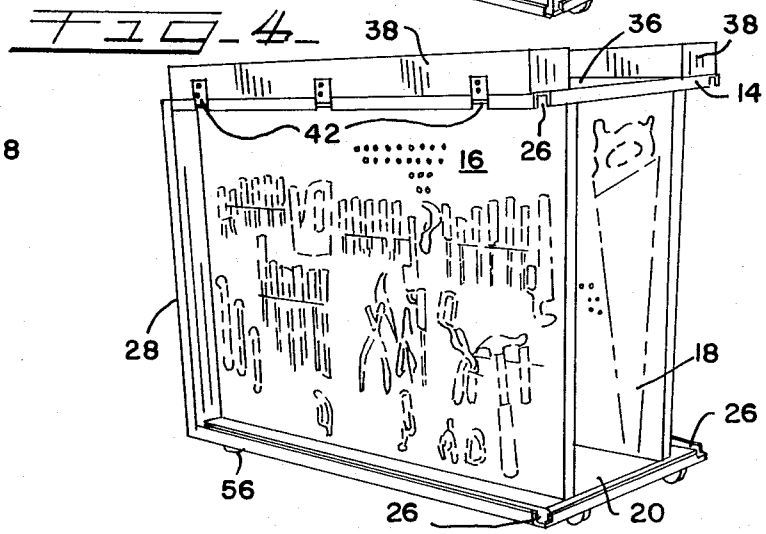
FIG. 4 is a view similar to FIG. 2 and showing storage areas.
Figure 6:
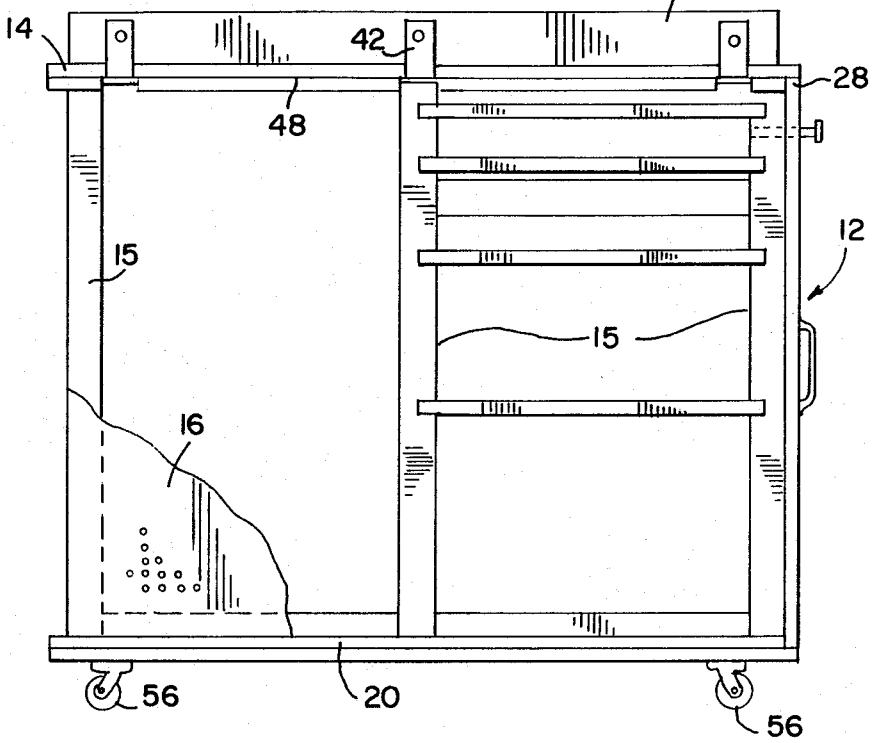
FIG. 6 is a side elevational view of the bench.
Figure 7:
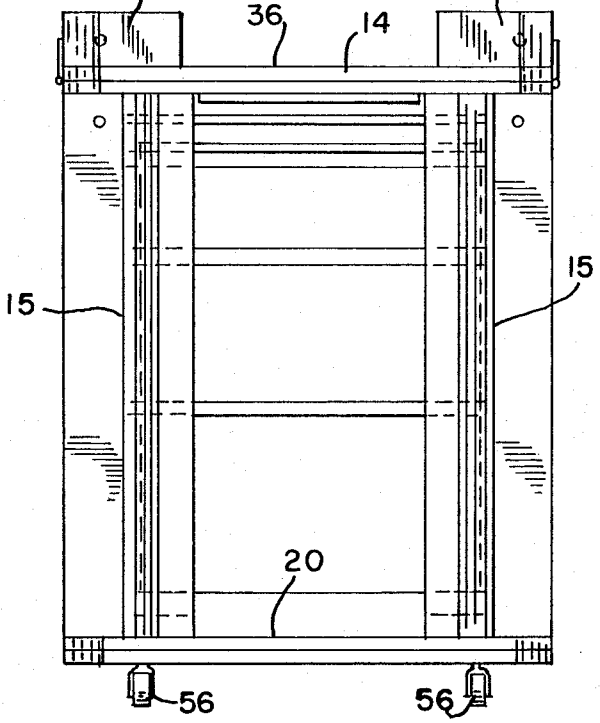
FIG. 7 is a front elevational view of the bench.

Indicated generally by the numeral 10 is a combination workbench and tool chest provided with a frame indicated generally at 12 and a top 14. The frame may be formed by two sets of vertically extending framing boards 15 (FIGS. 6 and 7) one set being at each side of the structure. The top 14 is secured to the upper ends of the boards 15 and a bottom or floor 20 (FIG. 4) is secured to the lower ends. Vertical sheets of pegboard 16 and 18 are fastened to opposite sides of each set of framing boards, as shown in FIG. 4. Pegs or hooks can be inserted into the holes of the pegboard for the storage of tools and equipment (shown in phantom). The back side of the frame is open as shown in FIG. 4, to allow for storage of larger equipment on the floor 20, or on hooks or pegs attached to the inside surfaces of the pegboards 16 or 18.

Figure 2:
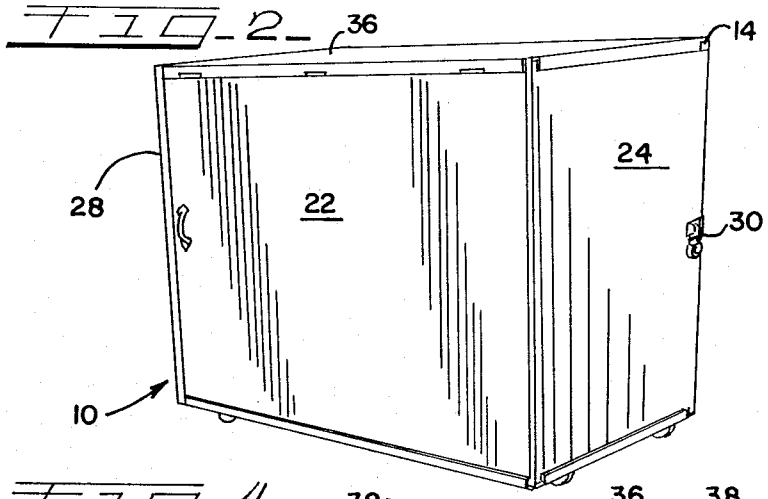
FIG. 2 is a view similar to FIG. 1 but showing the back and the other side.
Figure 1:
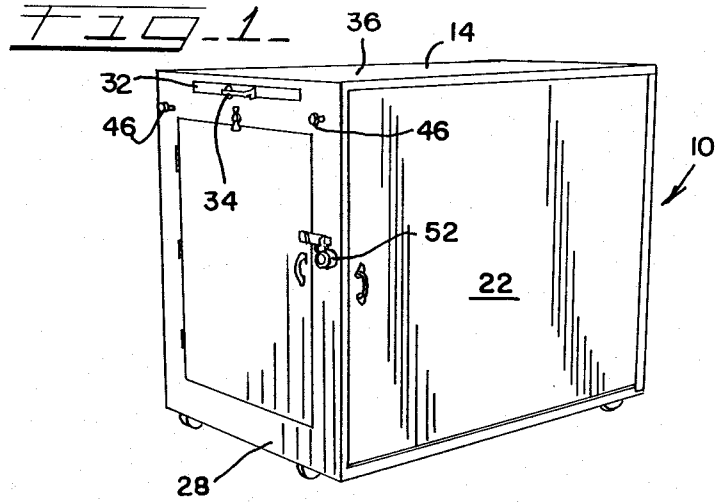
FIG. 1 is a perspective view showing the front and one side of a bench according to the invention.
Figure 4A:
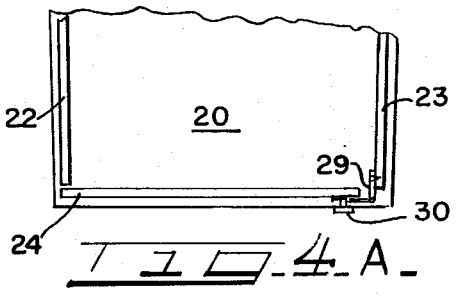
FIG. 4A is an enlarged fragmentary view of a corner of the bench.

Security cover panels 22, 23 and 24 are removably mounted on the opposite sides and on the back side of the frame, as shown in FIGS. 1, 2 and 4A. Each of these panels closes its respective side and can be removed by sliding it laterally along tracks 26 on the frame. The tracks 26 are formed on the upper side of the bottom 20 and the underside of the top just outside of the pegboards, there being sufficient clearance for tools to be hung between the pegboards and the panels.

The cover panel 22 is abutted laterally on its front end by front wall 28 and on its rearward end by rear panel 24. As shown in FIG. 2, the rear panel 24 overlies the rearward edge of the panel 22, the overlapping ends thus interconnecting the panels 22 and 24, and therefore the panel 22 cannot be removed unless rear panel 24 is previously removed.

Figure 3:
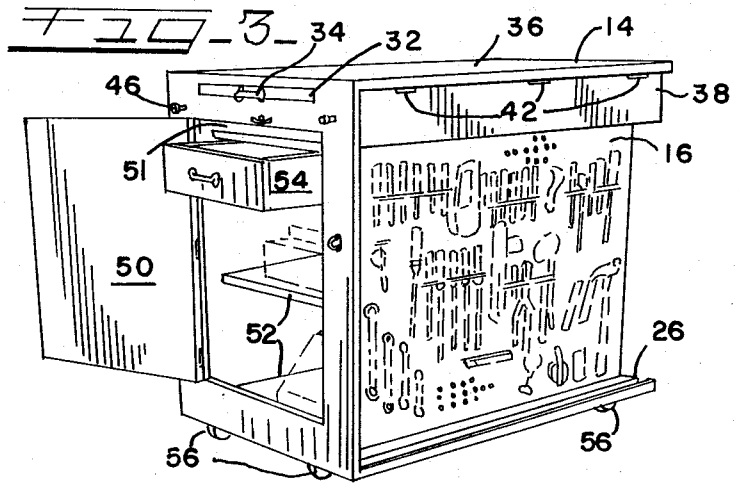
FIG. 3 is a view similar to FIG. 1 and showing storage areas.

A lock 30 holds panel 24 to the third cover panel 23, preventing either panel from being removed until the lock is released. With reference to FIG. 4A, a hasp 29 is fastened to the inner surface of the side panel 23 and it is bent over the rearward surface of the rear panel 24, where it is engaged by the lock 30. When the lock 30 is removed, the side panel 23 may be moved in the downward direction as seen in FIG. 4A and away from the remainder of the structure, then the rear panel 24 may be moved toward the right and away from the structure, and then the other side panel 22 may be removed. Installation of the panels is by the opposite procedure. Thus all three panels are secured in place using only a single lock. With all three cover panels removed, the workman has easy access to all his tools as shown in FIGS. 3 and 4.

Figure 5:
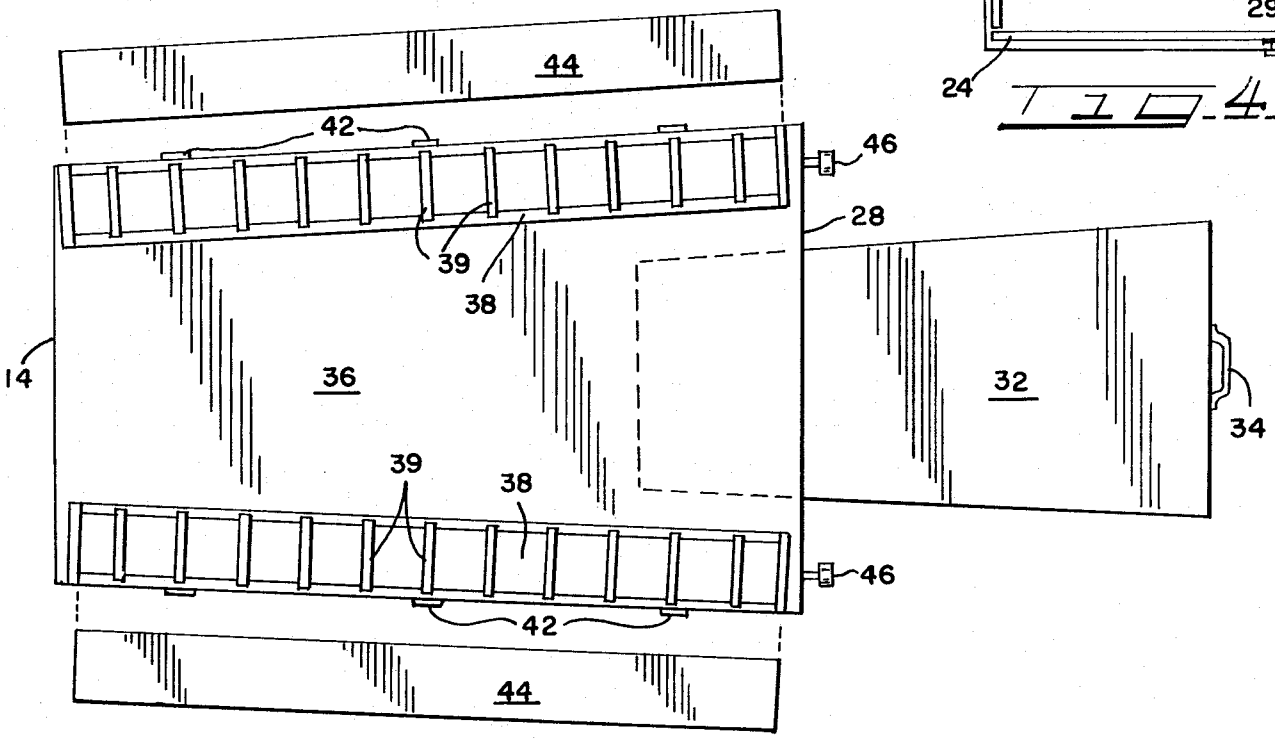
FIG. 5 is a top plan view of the bench.

The structure is also provided with an extension support 32 (FIGS. 1 and 5) which is mounted directly below top 14. This support is provided with a handle 34 on its exposed end by which it can be pulled out of frame 12 as shown in FIG. 5. When support 32 is extended, an extension board, not shown, or one of the side panels can be rested upon the support 32 to provide the workman with a large even working surface which is of significantly greater length than the normal working surface 36 formed by the top 14.

The structure is also provided with a pair of storage bins 38 (for small parts), mounted on the upper edges of the first and third sides of the structure. These bins 38 are shown in their top positions in FIGS. 4, 6 and 7 and in their storage positions in FIG. 3. A plurality of hinges 42 are fastened to the underside of the top 14 along the long edges, and the hinges are also attached to the bins 38. Each bin forms an elongated trough and has a series of spaced internal partitions 39; the partitions are preferably adjustable along the length of the bins so that smaller and larger items can be stored. A removable cover 44 is also provided over the top of each bin. When the side panels 22 and 23 are removed, the bins 38 may be swung on the hinges 42 from the storage positions shown in FIG. 3 and upwardly to the top positions where they rest on the upper surface of the top 14. In the top position, the covers 44 are uppermost and may be removed to expose the contents of the bins, which may be screws, bolts, etc. When swung to the storage positions, the bins are underneath the top 14. Pins 46 (FIG. 3) are pushed inwardly and enter holes in the end boards of the bins in order to hold the bins tucked in under the top. The bins are spaced inwardly of the side panels 22 and 23 and are covered by the panels when the structure is locked up.

The front wall 28 is provided with a lockable door 50 (FIGS. 1 and 3) which closes shelves 52 and a drawer 54, which shelves and drawer provide the workman with additional easy and accessible storage. An elongated storage space 51 is also provided just above the drawer for long objects such a yardsticks. A lock 52 is provided on the door.

The device is mounted on wheels 56 to allow it to be easily moved from place to place on the job site. The wheels preferably include mechanisms for preventing the bench from rolling when in use. Further, the bench is preferably tapered or narrowed its end which is opposite from the extension 32, which allows this end of the bench to be moved into restricted spaces.

It will be apparent from the foregoing that a novel and useful combination workbench and tool chest has been provided. When in use, the side panels are removed and the tools and other equipment are readily accessible from three sides of the bench. For storage, the panels enclose the equipment and are secured using only a simple lock. Another lock holds the door at the fourth side of the bench. The storage bins are easily movable for use of storage, and are secured using the same side security panels. An extension enables the work surface to be doubled when needed.

The pegboards may also be made removable if desired. An electrical outlet and a light may be mounted within the end of the bench shown in FIG. 4, and an extension cord may be provided to connect them to a live outlet.

I claim as my invention:

1. A combination tool chest and workbench comprising:

a top formed by a substantially planar top member;

a frame extending below said top member and forming four substantially vertical sides;

storing means on at least three of said sides for storing tools or equipment;

first, second and third cover panels removably mounted on said three sides for closing said storing means;

lock means for connecting said second and third cover panels; and said first and second cover panels including interconnecting means therebetween.

2. Apparatus as recited in claim 1, and further comprising:

a retractable extension support;

means for movably mounting said support within said frame and beneath and substantially adjacent to said top member;

an extension board forming an extension surface; the thickness of said board being substantially equal to the distance between the top of said member and the top of said extension support; and said extension support supporting said extension board in a position laterally adjacent to said top member whereby said top of said member and said extension surface are substantially coplanar.

3. Apparatus as recited in claim 1, and further comprising at least one storage bin:

means for rotating said bin about an edge of said top member between a top position above said top surface of said member and a storage position beneath and adjacent to said top member;

said storage bin including a removal cover which is openable when said storage bin is in said top position; and said panels covering said bin when in said storage position.

4. Apparatus as recited in claim 1, wherein:

said storing means for said first side and said third side each comprise pegboards;

said frame having slots formed therein and said cover panels sliding laterally in said slots on said frame; and said second cover panel abutting laterally against an end of said first cover panel.

5. A combination tool chest and workbench comprising:

a top member forming a substantially planar top surface;

at least one storage bin;

means for rotatably mounting said bin on an edge of said top member between a top position above said top surface and a storage position beneath and substantially adjacent to said top member;

said storage bin including a bin cover openable when said storage bin is in said top position; and means for holding said bin in said storage position 6. Apparatus as recited in claim 6, and further comprising:

a retractable extension support;

means for retractably mounting said support within and substantially adjacent to said top member;

an extension board forming an extension surface, the thickness of said board being substantially equal to the distance between said top surface and the top of said extension support; and said extension support comprising means for supporting said extension board in a position laterally adjacent to said top member whereby said top surface and said extension surface are substantially coplanar.

7. Apparatus as recited in claim 6, wherein:

said mounting means comprises at least one set of hinges connected to said bin and to said top;

said means for holding said bin in said storage position comprising a pin slidable in a hole on said frame and a hole on said bin.

8. Apparatus as recited in claim 7, and further including cover means for enclosing a side of said workbench, said extension board being formed by one of said cover means.

* * * * *